US012263397B2

(12) United States Patent
Lee

(10) Patent No.: US 12,263,397 B2
(45) Date of Patent: Apr. 1, 2025

(54) BEGINNER'S INLINE SKATE WITH ANTI-ROLLING DEVICE

(71) Applicant: Na Yoon Lee, Anyang-si (KR)

(72) Inventor: Na Yoon Lee, Anyang-si (KR)

( * ) Notice: Subject to any disclaimer, the term of this patent is extended or adjusted under 35 U.S.C. 154(b) by 21 days.

(21) Appl. No.: 18/460,933

(22) Filed: Sep. 5, 2023

(65) Prior Publication Data

US 2024/0075377 A1 Mar. 7, 2024

(30) Foreign Application Priority Data

Sep. 6, 2022 (KR) ..... 10-2022-0112507

(51) Int. Cl.
*A63C 17/14* (2006.01)
*A63C 17/06* (2006.01)

(52) U.S. Cl.
CPC ..... *A63C 17/1454* (2013.01); *A63C 17/06* (2013.01); *A63C 17/1427* (2013.01)

(58) Field of Classification Search
CPC . A63C 17/06; A63C 17/1427; A63C 17/1454; A63C 2203/00
See application file for complete search history.

(56) References Cited

U.S. PATENT DOCUMENTS 3,790,187 A * 2/1974 Radu ..... A61H 3/04 280/11.201
4,334,690 A * 6/1982 Klamer ..... A63C 17/1436 280/11.208
5,704,618 A * 1/1998 Sfoggia ..... A63C 17/226 280/11.214
5,924,704 A * 7/1999 Johnson ..... A63C 17/1418 280/11.211
6,012,725 A * 1/2000 Mitchell ..... A63C 17/1409 280/11.211
6,478,312 B1 * 11/2002 Petrucci ..... A63C 17/1427 188/29
2008/0029979 A1 * 2/2008 Chang ..... A63C 17/06 280/11.206
2008/0084034 A1 * 4/2008 Feldman ..... A63C 1/28 280/11.115
2010/0320707 A1 * 12/2010 Chang ..... A63C 17/1454 280/11.225

FOREIGN PATENT DOCUMENTS

KR 19970011075 B1 7/1997
KR 200310888 Y1 4/2003

* cited by examiner

*Primary Examiner* — Brian L Swenson
(74) *Attorney, Agent, or Firm* — STIP Law Group, LLC

(57) ABSTRACT

The present disclosure relates to a beginner's inline skate which can prevent rolling in place. A beginner's inline skate with an anti-rolling device according to the present disclosure includes an anti-rolling device installed on at least one wheel of wheels of the inline skate, wherein the anti-rolling device includes: an anti-rotation catching step formed around a rotating shaft of the wheel; and a rotator installed to rotate about a circumference of the rotating shaft of the wheel and having catching protrusions formed to be caught at the anti-rotation catching step and lock rotation of the wheel.

9 Claims, 6 Drawing Sheets

BEGINNER'S INLINE SKATE WITH ANTI-ROLLING DEVICE

CROSS-REFERENCE TO RELATED APPLICATION

This application claims priority to and the benefit of Korean Patent Application No. 2022-0112507, filed on Sep. 6, 2022, the disclosure of which is incorporated herein by reference in its entirety.

BACKGROUND

1. Field of the Invention

The present disclosure relates to an inline skate, and more particularly, to a beginner's inline skate which can prevent rolling in place.

2. Discussion of Related Art

When learning inline skating for the first time, beginners have difficulty keeping their balance and roll in place (kick forward with both feet alternately as shown in FIG. 1) and eventually fall backwards and fall on their buttocks and get hurt in many cases.

Conventionally, inline skates with a backward movement preventing function or a brake function have been disclosed (refer to Patent Documents 1 and 2 listed below), but a beginner's inline skate which can prevent accidents due to rolling in place (kicking) has not been disclosed.

(Patent Document 1) KR 20-0310888 Y1 (Apr. 21, 2003)

(Patent Document 2) KR 10-1997-0011075 B1 (Jul. 7, 1997)

SUMMARY OF THE INVENTION

The present disclosure is directed to providing a beginner's inline skate which prevents rotation of wheels of the inline skate when an abnormal motion of a fast, strong forward kick occurs, unlike a normal skating motion, thus preventing accidents due to rolling in place.

A beginner's inline skate with an anti-rolling device according to the present disclosure includes an anti-rolling device installed on at least one wheel of wheels of the inline skate, wherein the anti-rolling device includes: an anti-rotation catching step formed around a rotating shaft of the wheel; and a rotator installed to rotate about a circumference of the rotating shaft of the wheel and having catching protrusions formed to be caught at the anti-rotation catching step and lock rotation of the wheel.

A weight may be disposed on one side portion of the rotator.

The rotator may be formed in an arch shape to be positioned on the circumference of the rotating shaft of the wheel, and an operating body may be formed to extend through an extension on the one side portion.

The weight may be disposed on the operating body.

A one-way rotating gear configured to rotate while engaged with rotation of the rotator may be disposed on one side of the rotator.

An engaging surface engaged with the one-way rotating gear may be formed on one side surface of the operating body of the rotator.

The catching protrusions of the rotator may be formed only on an inner side surface on a side of the rotator where the weight is not disposed about a rotating shaft of the rotator, and an inner side surface on a side of the rotator where the weight is disposed, which is an opposite side, may be formed as a smooth surface on which the catching protrusions are not formed.

The catching protrusions of the rotator may have an asymmetrical shape.

The anti-rolling device may further include a disengaging mechanism configured to disengage the one-way rotating gear and the rotator from each other.

The disengaging mechanism may include a lever and a tension spring configured to elastically support the lever on one side.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present disclosure will be described with reference to the accompanying drawings. However, detailed description of known functions and configurations that may unnecessarily obscure the gist of the present disclosure will be omitted.

Figure 1:
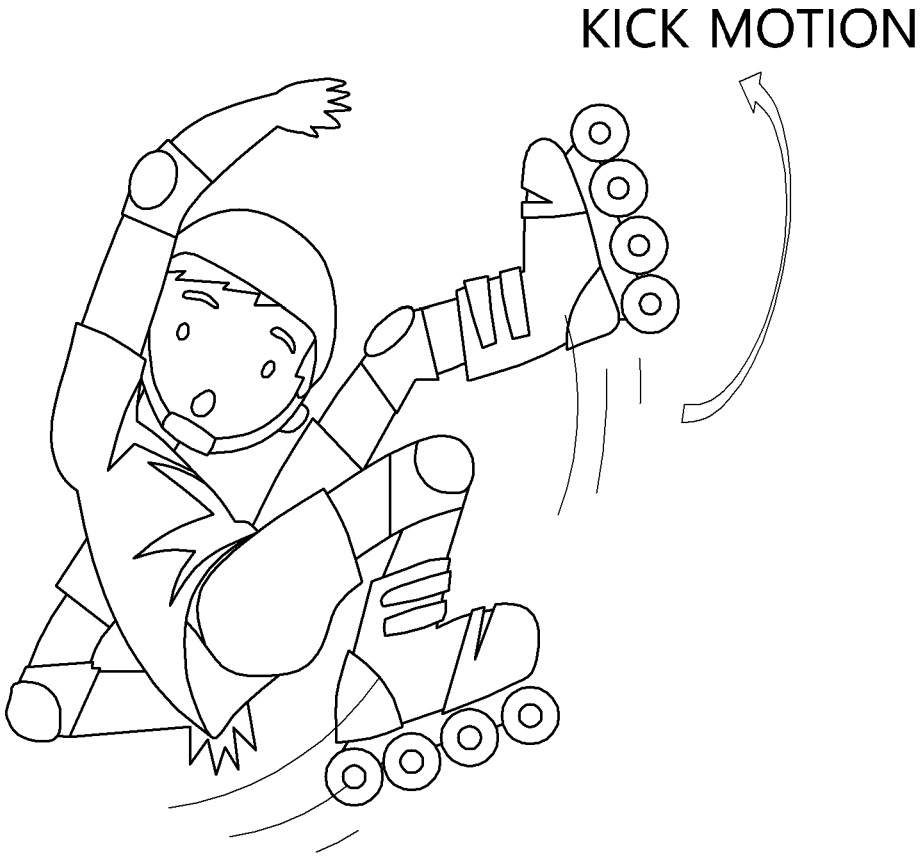
FIG. 1 is a view illustrating a state in which a beginner falls backward and falls on the beginner's buttocks due to rolling in place.
Figure 2:
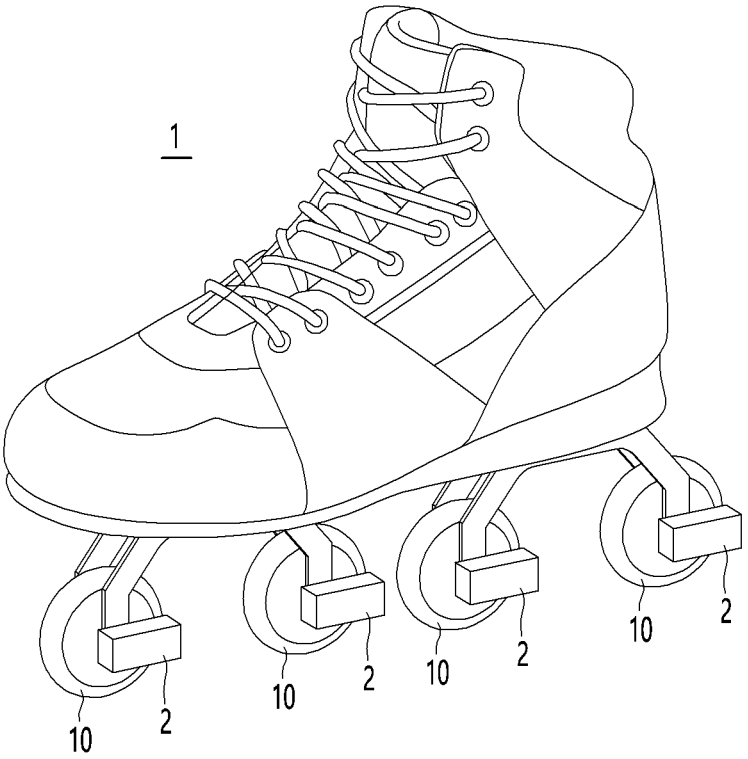
FIG. 2 is a view illustrating a beginner's inline skate with an anti-rolling device according to the present disclosure.
Figure 3:
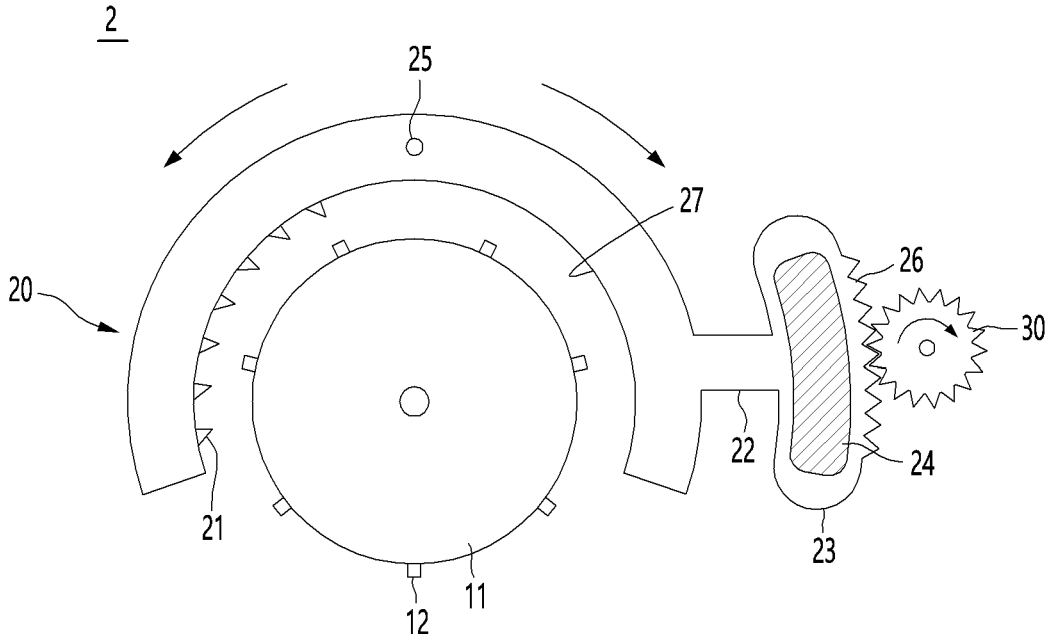
FIG. 3 is a view illustrating an internal structure of the anti-rolling device according to the present disclosure.

FIG. 2 is a view illustrating a beginner's inline skate with an anti-rolling device according to the present disclosure, and FIG. 3 is a view illustrating an internal structure of the anti-rolling device according to the present disclosure.

As illustrated in FIG. 2, a beginner's inline skate with an anti-rolling device according to the present disclosure includes an anti-rolling device 2 installed on at least one wheel 10 of wheels 10 of an inline skate 1.

Referring to FIG. 3, the anti-rolling device 2 includes an anti-rotation catching step 12 formed around a rotating shaft 11 of the wheel 10 and a rotator 20 installed to rotate about a circumference of the rotating shaft 11 of the wheel 10 and having catching protrusions 21 formed to be caught at the anti-rotation catching step 12 and lock rotation of the wheel 10.

A weight 24 is disposed on one side portion of the rotator 20. During a normal skating motion at ordinary times, the rotator 20 is positioned in a state in which it is rotated in a direction in which the catching protrusions 21 of the rotator 20 are not caught at the anti-rotation catching step 12 of the wheel 10 due to a weight of the weight 24. However, when a fast, strong kick motion due to rolling in place occurs, the rotator 20 is positioned in a state in which it is rotated in a direction in which the catching protrusions 21 of the rotator 20 are caught at the anti-rotation catching step 12 of the wheel 10 due to inertia of the weight 24 so that rolling-in-place of the wheel 10 stops.

That is, the principle of the anti-rolling device according to the present disclosure is to allow the wheel 10 to roll during a normal skating motion, i.e., while the skate 1 slowly moves back and forth, and to lock the wheel 10 and prevent rolling thereof while rolling in place occurs, i.e., when a fast, strong kick motion occurs.

The rotator 20 is formed in an arch shape to be positioned on the circumference of the rotating shaft 11 of the wheel 10, and an operating body 23 is formed to extend through an extension 22 disposed to form a long arm structure on the one side portion.

The weight 24 is disposed on the operating body 23 and may be integrally disposed inside the operating body 23.

In the present disclosure, the rotator 20 allows the weight 24 to be further apart from a rotating shaft 25 of the rotator 20 through the long arm structure formed through the extension 22, and accordingly, the rotator 20 can more easily receive the influence of gravity and inertia due to the weight of the weight 24.

A one-way rotating gear 30 configured to rotate while engaged with rotation of the rotator 20 is provided on one side of the rotator 20 and allows the rotator 20 to continuously maintain its position after rotating in a direction in which the catching protrusions 21 of the rotator 20 are caught at the anti-rotation catching step 12 of the wheel 10 due to the inertia of the weight 24. An engaging surface 26 engaged with the one-way rotating gear 30 is disposed on one side surface of the operating body 23 of the rotator 20.

The catching protrusions 21 of the rotator 20 are formed only on an inner side surface on a side of the rotator 20 where the weight 24 is not disposed about the rotating shaft 25, and an inner side surface on a side of the rotator 20 where the weight 24 is disposed, which is the opposite side, is formed as a smooth surface 27 on which the catching protrusions 21 are not formed.

Figure 4:
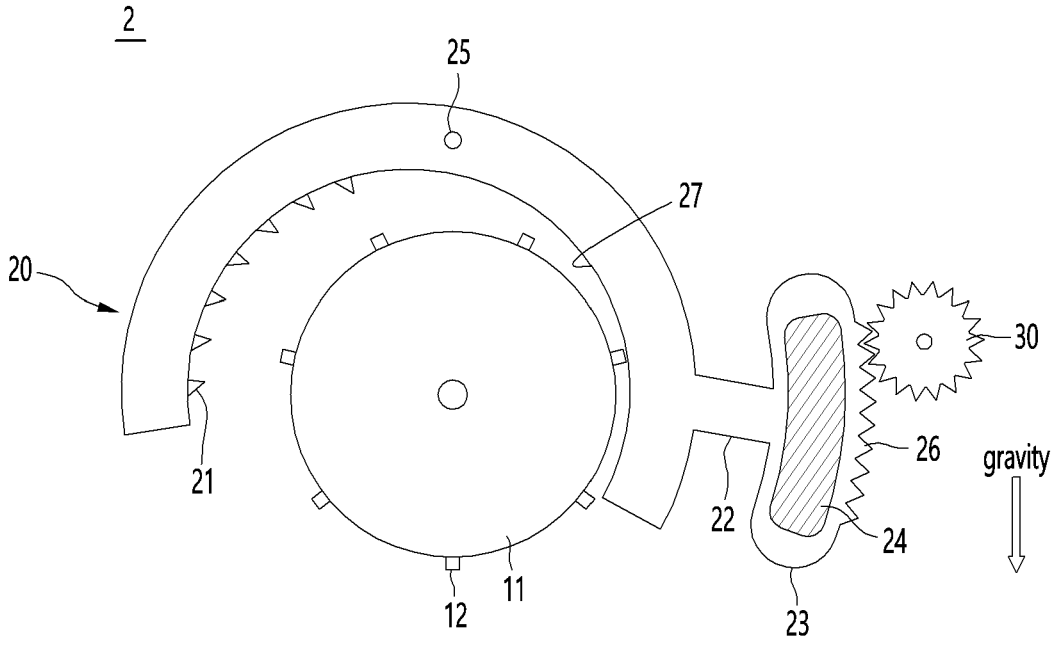
FIG. 4 is a view illustrating an operational state of the anti-rolling device according to the present disclosure during a normal skating motion.
Figure 5:
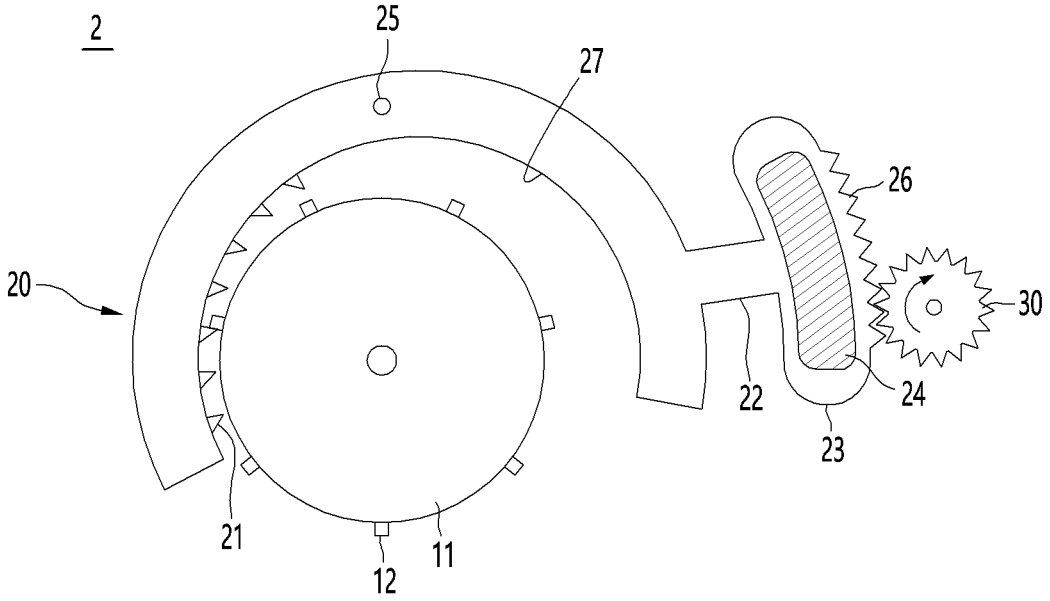
FIG. 5 is a view illustrating an operational state of the anti-rolling device according to the present disclosure when a strong kick motion occurs.

FIG. 4 is a view illustrating an operational state of the anti-rolling device according to the present disclosure during a normal skating motion, and FIG. 5 is a view illustrating an operational state of the anti-rolling device according to the present disclosure when a strong kick motion occurs.

Referring to FIGS. 4 and 5, during a normal skating motion at ordinary times, the rotator 20 is positioned at a position in which the catching protrusions 21 are not caught at the anti-rotation catching step 12 due to the weight of the weight 24 (State 1, refer to FIG. 4), and thus the wheel 10 is allowed to normally rotate. When a fast, strong kick motion due to rolling in place occurs, the rotator 20 is positioned at a position in which the catching protrusions 21 are caught at the anti-rotation catching step 12 due to inertia of the kick motion (State 2, refer to FIG. 5), and thus the wheel 10 is not allowed to rotate.

More specifically, at the position in State 1, since the anti-rotation catching step 12 of the wheel 10 is in contact with the smooth surface 27 of the rotator 20, the wheel 10 is not caught and thus rotates normally, and at the position in State 2, the anti-rotation catching step 12 of the wheel 10 is caught at the catching protrusions 21 of the rotator 20, and thus the wheel 10 is prevented from rolling in place.

The catching protrusions 21 may have an asymmetrical shape (refer to FIGS. 3 to 5) so that, in State 2, the wheel 10 is prevented from rotating in a direction in which rolling in place occurs but can rotate in the opposite direction. When rotation of the wheel 10 is allowed in the opposite direction of the direction in which rolling in place occurs, rather than completely locking the rotation of the wheel 10, as described above, it is easier for a user to adjust the user's posture after a kick motion.

Therefore, in a case in which a user loses balance and rolling in place occurs, the wheel 10 is locked immediately after one kick motion and rolling in place does not occur anymore, and thus the user can regain the user's balance immediately and does not fall backwards.

Meanwhile, the rotator 20 rotated as in State 2 continuously maintains its state due to the one-way rotating gear 30. In order to allow the rotator 20 to return to State 1 when the user regains the user's balance after rolling in place, a disengaging mechanism 40 configured to disengage the one-way rotating gear 30 and the rotator 20 from each other is installed. In a case in which the user wishes to carry on skating after regaining the user's balance, the user may manipulate the disengaging mechanism 40 so that the rotator 20 returns to State 1. The disengaging mechanism 40 may be made in the form of a lever mechanism which can move the one-way rotating gear 30 in a direction moving away from the rotator 20.

Figure 6:
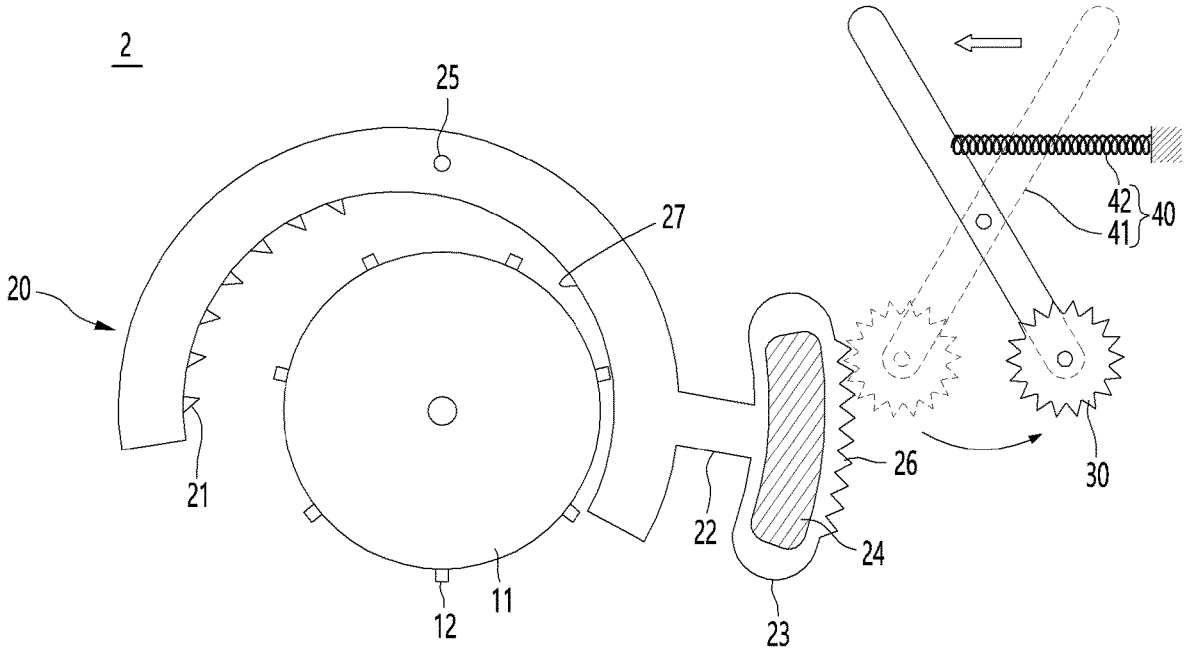
FIG. 6 is a view illustrating an operation of a disengaging mechanism of the anti-rolling device according to the present disclosure.

FIG. 6 is a view illustrating an operation of the disengaging mechanism of the anti-rolling device according to the present disclosure. Referring to FIG. 6, the lever mechanism may include a lever 41 and a tension spring 42 configured to elastically support the lever 41 on one side.

The above-described anti-rolling device according to the present disclosure can be directly installed on a wheel of an inline skate, is operated by inertia of a weight, and prevents inline skating beginners from falling on their buttocks, which is common, to prevent accidents.

Also, the anti-rolling device according to the present disclosure is manufactured in a simple form using rotation of a rotator including a weight and thus is easy to manufacture, low-cost, and can be easily added to existing inline skates.

A beginner's inline skate with an anti-rolling device according to the present disclosure prevents rotation of wheels of the inline skate while rolling in place, thus preventing inline skating beginners from falling on their buttocks, which is common, to prevent accidents.

Also, for inline skating beginners, it is possible to eliminate a difficulty in keeping balance due to rolling in place and allow the beginners to learn inline skating easily and conveniently.

The embodiments of the present disclosure have been described in detail above with reference to the accompanying drawings, but the embodiments disclosed in the present application and the accompanying drawings are only used for the purpose of easily describing the technical spirit of the present disclosure and are not intended to limit the scope of the present disclosure defined in the claims below. Therefore, those of ordinary skill in the art should understand that various modifications and other equivalent embodiments are possible from the above-described embodiments.

What is claimed is:

1. A beginner's inline skate with an anti-rolling device, the inline skate comprising an anti-rolling device installed on at least one wheel of wheels of the inline skate, wherein the anti-rolling device includes:

an anti-rotation catching step formed around a rotating shaft of the wheel; and a rotator installed to rotate about a circumference of the rotating shaft of the wheel and having catching protrusions formed to be caught at the anti-rotation catching step and lock rotation of the wheel, wherein a weight is disposed on one side portion of the rotator.

2. The inline skate of claim 1, wherein the rotator is formed in an arch shape to be positioned on the circumference of the rotating shaft of the wheel, and an operating body is formed to extend through an extension on the one side portion.

3. The inline skate of claim 2, wherein the weight is disposed on the operating body.

4. The inline skate of claim 2, wherein a one-way rotating gear configured to rotate while engaged with rotation of the rotator is disposed on one side of the rotator.

5. The inline skate of claim 4, wherein engaging surface engaged with the one-way rotating gear is formed on one side surface of the operating body of the rotator.

6. The inline skate of claim 4, wherein the anti-rolling device further includes a disengaging mechanism configured to disengage the one-way rotating gear and the rotator from each other.

7. The inline skate of claim 6, wherein the disengaging mechanism includes a lever and a tension spring configured to elastically support the lever on one side.

8. The inline skate of claim 1, wherein the catching protrusions of the rotator are formed only on an inner side surface on a side of the rotator where the weight is not disposed about a rotating shaft of the rotator, and an inner side surface on a side of the rotator where the weight is disposed, which is an opposite side, is formed as a smooth surface on which the catching protrusions are not formed.

9. The inline skate of claim 1, wherein the catching protrusions of the rotator have an asymmetrical shape.

* * * * *